US006584751B1

(12) United States Patent
Werner

(10) Patent No.: US 6,584,751 B1
(45) Date of Patent: Jul. 1, 2003

(54) HIGH SPEED MACHINE FOR INSERTING SHEETS INTO ENVELOPES

(76) Inventor: Todd C. Werner, 3050 Alton Dr., St. Pete Beach, FL (US) 33706

( * ) Notice: Subject to any disclaimer, the term of this patent is extended or adjusted under 35 U.S.C. 154(b) by 0 days.

(21) Appl. No.: 10/065,081

(22) Filed: Sep. 16, 2002

Related U.S. Application Data

(62) Division of application No. 09/630,116, filed on Aug. 1, 2000, now Pat. No. 6,453,651.

(51) Int. Cl.[7] ..... B65B 43/26

(52) U.S. Cl. ..... 53/381.5; 53/381.6; 53/569; 53/382.1

(58) Field of Search ..... 53/381.5, 381.6, 53/381.7, 569, 382.1; 493/917

(56) References Cited

U.S. PATENT DOCUMENTS 3,474,711 A * 10/1969 Swinyar
3,974,749 A * 8/1976 Luperti et al.
5,156,585 A * 10/1992 Dimur et al. ..... 53/381.7
5,581,972 A * 12/1996 Antonelli ..... 53/381.6
5,675,959 A * 10/1997 Hamma et al. ..... 53/381.5

* cited by examiner

*Primary Examiner*—Eugene Kim
*Assistant Examiner*—Sameh Tawfik
(74) *Attorney, Agent, or Firm*—Ronald E. Smith; Smith & Hopen, P.A.

(57) ABSTRACT

Improvements in high-speed machines for inserting sheets into envelopes include a first apparatus for pre-opening envelopes after they are pulled from a hopper and before a blade-like envelope flap opener fully opens them. The first apparatus includes a roller and a roller housing having a top part that defines a small space between them through which a flap-including longitudinal edge of an envelope passes. The edge is constrained to form a curvature as it passes through the small space, causing the flap to open at least to some extent. A second improvement in pre-openers includes a cut out formed in an envelope support plate and a rigid deflector positioned in the path of the envelopes as they leave the hopper. The envelope flaps are partly opened as they are deflected below the plane of the support plate. A third improvement includes a plurality of vacuum dishes formed in an envelope-supporting plate. The vacuum dishes are in fluid communication with a source of air under negative pressure and parts of the address side of an envelope are pulled into the vacuum dishes when a vacuum is applied. This increases the separation between the address side of the envelope and the opposing side to facilitate the sheet insertion process.

2 Claims, 4 Drawing Sheets

HIGH SPEED MACHINE FOR INSERTING SHEETS INTO ENVELOPES

RELATED APPLICATION

This disclosure is a division of a disclosure of the same title by the same inventor, filed Aug. 1, 2000 now U.S. Pat. No. 6,453,651, bearing Ser. No. 09/630,116.

BACKGROUND OF THE INVENTION

1. Field of the invention

This invention relates, generally, to machines that insert sheets into envelopes at high speeds. More particularly, it relates to improvements in such machines in their envelope-opening mechanisms.

2. Description of the prior art

High speed machines for inserting sheets into envelopes generally include an envelope feed conveyor means for delivering envelopes to a hopper, means for sequentially removing the envelopes from the hopper, means for sequentially opening the envelopes, means for inserting sheets into the envelopes, and means for closing the envelopes and delivering them to a discharge table where they are bundled for mailing.

Typically, the envelopes travel in the same direction as the sheets.

The conventional means for opening an envelope includes a stationary blade-like member disposed in the path of an envelope as the envelope is transported from the hopper to a sheet insertion station. The blade-like member has no moving parts, i e. , it is passive in operation and simply deflects the flap of an envelope being pulled past it into an open position. When an envelope with an open flap arrives at the sheet insertion station, prior art machines include movably mounted suction cups that deploy, grasp the envelope, and hold the body of the envelope open while sheets are inserted thereinto.

In a disclosure, application Ser. No. 09/250,459 filed Feb. 16, 1999, by the same inventor, which is hereby incorporated by reference into this disclosure, the sheets and envelopes do not travel in the same direction. Instead, an envelope insertion table having a sheet insertion station is disposed at a right angle to the envelope inserting means. Horizontal air jets are used to puff open the main body of the envelope at the sheet insertion station, thereby eliminating the suction cups of the prior art.

However, a few problems remain. For example, a passive blade-like member, disposed between the envelope hopper and the sheet insertion station, sometimes fails to function satisfactorily because an envelope flap might be stuck in a closed position and the blade-like member thus may fail to get under the flap to deflect it into its open position. Thus, means for pre-opening the envelope are needed to improve the operation of the blade-like device.

Secondly, even if a flap is not stuck in a closed position, there are times when the blade fails to catch the flap correctly, and the desired deflection fails to occur. Thus, there is a need for an improved envelope flap deflection blade.

Moreover, although air jets are more satisfactory than reciprocating suction cups for holding the main body of the envelope open during sheet insertion, the leading end of an envelope will sometimes fail to open properly because a clamp used to pull the envelope through the machine will hold down the leading end of the envelope and thus at least partially defeat the action of the horizontal air jets.

Accordingly, there is a need for an auxiliary means for opening the main body of the envelope at a sheet insertion station to augment the function of the airjets.

However, it was not obvious to those of ordinary skill in this art how the needed improvements could be provided, in view of the art considered as a whole at the time the present invention was made.

SUMMARY OF INVENTION

The long-standing but heretofore unfulfilled need for innovations that overcome the limitations of the prior art is now met by a new, useful, and nonobvious invention.

The invention includes an apparatus for at least partially pre-opening the flap of an envelope. The novel flap pre-opener forms a part of a machine for inserting sheets into envelopes; specifically, it is mounted on the edge of a table having a substantially horizontal support surface that supports envelopes as they are carried from a first station such as an envelope hopper to a second station such as a sheet insertion station. The envelope hopper or other suitable envelope alignment means aligns the envelopes relative to the support surface so that a flap-including longitudinal edge of the envelopes at least slightly overhang the edge of the table where the novel flap pre-opener is mounted as the envelopes travel from the envelope hopper to the sheet insertion station. In this way, said flap-including edges are constrained to pass through the flap pre-opener.

More particularly, the novel pre-opener includes a roller housing having an upwardly-opening channel formed therein within which a wheel is mounted for rotation in a vertical plane. The channel divides the roller housing into a table edge-abutting inboard part and an outboard part. The wheel is mounted such that its uppermost peripheral edge extends slightly above the plane of the support surface upon which an envelope is disposed in substantially horizontal disposition. The flap-including longitudinal edge of an envelope passing over the wheel is therefore lifted a small distance above said support surface by the wheel.

The roller housing includes a top part having a recess formed therein that is tapered downwardly from the direction of the envelope hopper to the sheet insertion station. The top part is positioned in closely spaced relation to the uppermost peripheral edge of the wheel on the outboard side of the roller housing. The recess is elevated to a first height at the entrance to the pre-opening station on the envelope hopper side of the pre-opener so that it does not interfere with the elevated edge of the envelope that is raised above the support surface by the wheel. The recess tapers downwardly toward the exit end of the pre-opener, constraining the edge of the envelope to bend downwardly at the same time the wheel is lifting the envelope near its outboard edge. This forms an arcuate curvature in the envelope back wall and causes the flap of the envelope to separate from said back wall. The separation provides an opening between the envelope back wall and flap into which a stationary flap-opening blade may enter as the envelope exits the pre-opener.

In another embodiment of the machine, the pre-opening of envelopes as they exit the envelope hopper is accomplished in the absence of the pre-opener just described. In this embodiment, a predetermined section of the support plate upon which the envelopes lie as they travel from the envelope hopper to a sheet insertion station is cut away so that the flap area of an envelope is not fully supported when it is in registration with said cut away. A stationary rigid deflector arm extends downwardly into the pathway of the flap area of the envelopes as they travel away from the envelope hopper, constraining the flap area to bend downwardly, below the plane of the support surface. This has essentially the same effect as the pre-opener described above. When the back of the envelope is deflected downwardly, the flap part thereof juts out therefrom, creating a space into which the stationary blade may enter.

This invention further includes an apparatus for holding open an envelope to facilitate insertion of a sheet therewithin, said apparatus also forming a part of a machine for inserting sheets into envelopes. The apparatus includes a modification to the above-mentioned support plate for supporting the back area of an envelope during a sheet insertion process. A plurality of longitudinally spaced apart recessed vacuum dishes are formed in the support plate, and each vacuum dish is in open fluid communication with a source of negative air pressure. The back wall (address side) of an envelope overlies the support plate during the sheet insertion process and each part of the address side of the envelope in registration with a vacuum dish is pulled downwardly when a negative pressure is applied to the vacuum dish. Accordingly, a space between the address side of the envelope and an opposing side thereof is widened when said parts of the address side are pulled downwardly, thereby facilitating insertion of a sheet into the envelope.

More particularly, the support plate within which the vacuum dishes are formed is made in two parts, one of which is stationary and one of which is slideably mounted. Both support plates lie in a common plane. A vacuum dish formed in the stationary part of the support plate is positioned so that it is in registration with a leading end of an envelope positioned at a sheet insertion station. A clamp that forms a part of a mechanism that sequentially pulls envelopes through the machine holds the leading end of the envelope. A plurality of longitudinally spaced apart vacuum dishes is formed in the slideably mounted support plate.

The novel apparatus includes a manifold means for delivering air under negative pressure from a vacuum source to each of the vacuum dishes. The manifold means includes flexible hoses that interconnect the vacuum source and the vacuum dishes so that the fluid communication between the vacuum source and the vacuum dishes is not lost when the slideably mounted support plate is displaced.

A short envelope is opened by a suction appearing at the stationary vacuum dish and by a suction appearing simultaneously at a first vacuum dish formed in the slideably mounted support plate, said first vacuum dish being nearest said stationary vacuum dish. A medium length envelope is opened by a suction appearing at the stationary vacuum dish and simultaneously at a second vacuum dish formed in the slideably mounted support plate, said second vacuum dish being spaced further from said stationary vacuum dish than said first vacuum dish formed in said slideably mounted support plate. A long envelope is opened by a suction appearing at the stationary vacuum dish and simultaneously at a third vacuum dish formed in the slideably mounted support plate, said third vacuum dish being spaced further from said stationary vacuum dish than said second vacuum dish. To accommodate still longer envelopes, the slideably mounted support plate is slid a preselected distance to a position further from the stationary support plate.

It is therefore understood that a primary object of this invention is to provide means for pre-opening an envelope flap to thereby enhance the performance of a conventional envelope flap-opening blade.

Another object is to provide an envelope pre-opener having no moving parts.

Another important object is to provide means for facilitating the opening of the main body of an envelope at a sheet insertion station.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
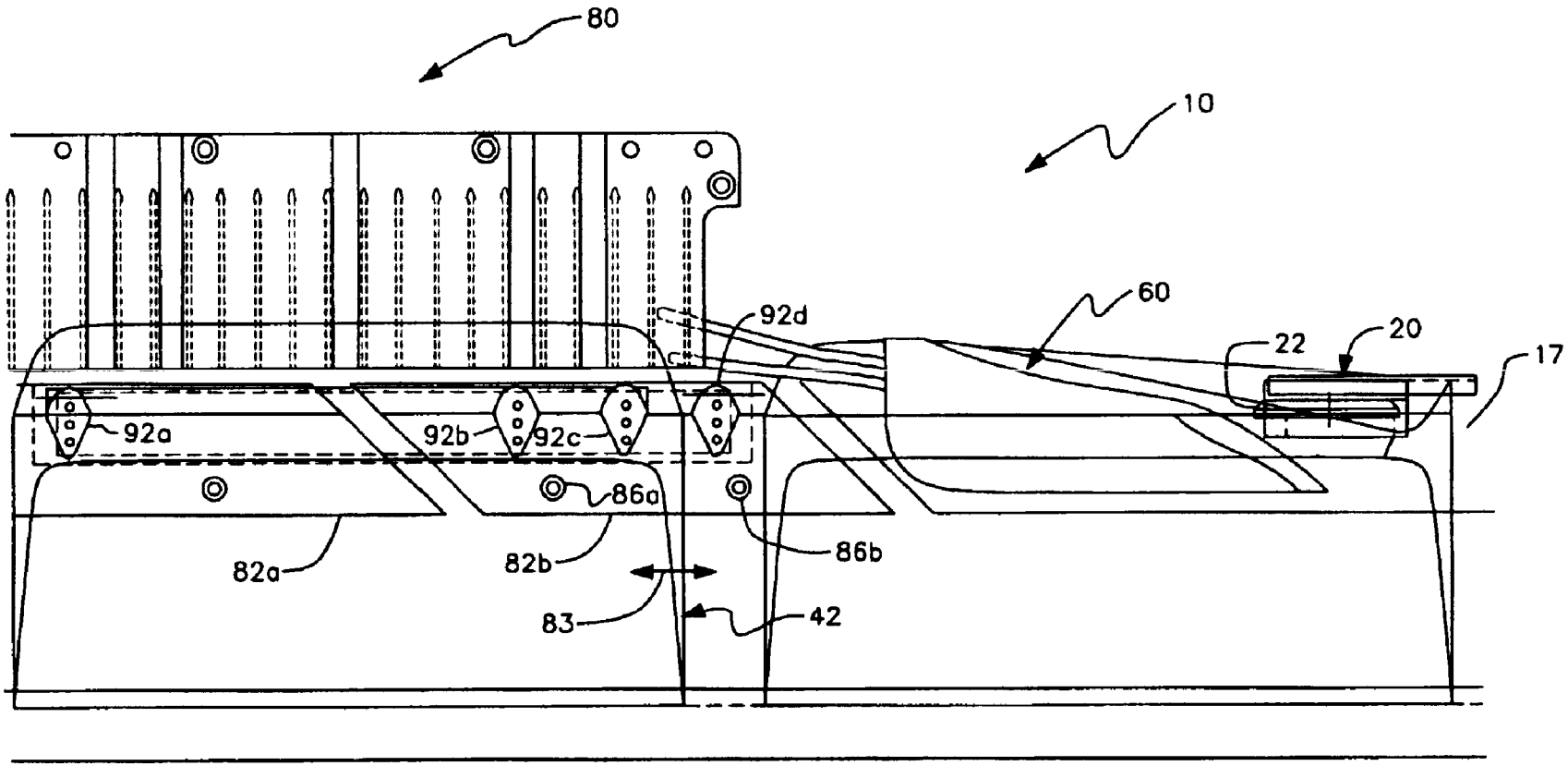
FIG. 1 is a diagrammatic top plan view of the forward end of a high-speed sheet insertion machine.

Referring now to FIG. 1, it will there be seen that the forward end of a high speed machine for inserting sheets into envelopes having all three of the innovations of this invention is diagrammatically depicted and denoted as a whole by the reference numeral 10.

The first innovation of this invention is denoted 20 in FIG. 1. Envelope pre-opener 20 is positioned between an envelope hopper, not shown, and blade-like envelope flap-opening member 60. It is mounted in a vertical plane on a mounting plate 17 that forms a part of a table that includes a sheet insertion station 80 where sheets are inserted into open envelopes. As best understood in connection with the incorporated disclosure, the table is transversely disposed relative to a longitudinally disposed envelope feed table and a longitudinally disposed sheet insertion table. Thus, each envelope approaches the unillustrated envelope hopper along a longitudinal path of travel and is discharged from the hopper along a transverse path of travel. Sheets to be inserted into each envelope also follow a longitudinal path of travel. Accordingly, each envelope after exiting the envelope hopper follows a path of travel that is at a right angle to the sheet or sheets being inserted thereinto.

Figure 2:
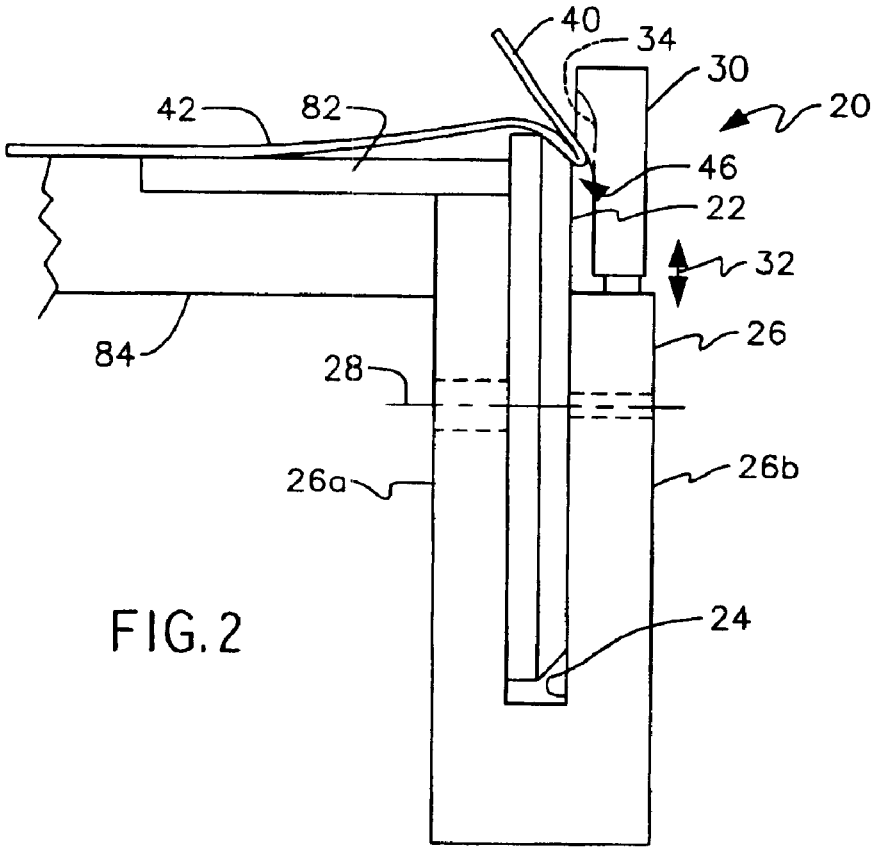
FIG. 2 is an end elevational view of a first embodiment of means for pre-opening an envelope.
Figure 3:
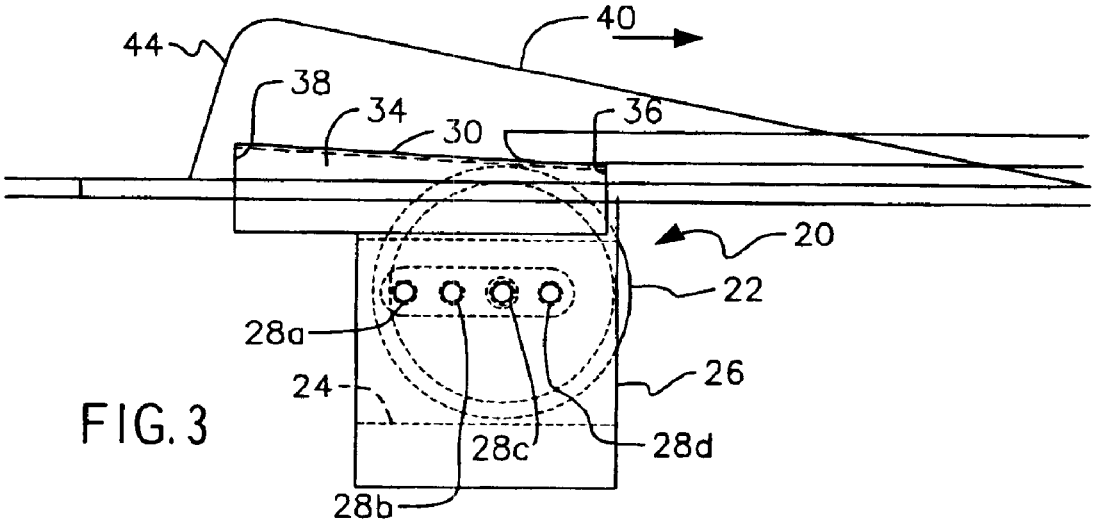
FIG. 3 is a front elevational view of the means depicted in FIG. 2.

As best understood in connection with FIGS. 2 and 3, wheel or roller 22 is rotatably mounted in an upwardly-opening channel 24 formed in roller housing 26. The horizontal axis of rotation is denoted 28. Note that channel 24 divides roller housing 26 into an inboard part 26*a* that abuts the edge of the table and an outboard part 26*b*. Roller housing 26 includes a top part 30 that is height-adjustable relative to housing 26 as indicated by double-headed directional arrow 32. A tapered recess 34 is formed in top part 30; the recess is greater in height at the discharge end of pre-opener 20 (the end nearest the sheet insertion station and farthest from the envelope hopper) than it is at the end thereof nearest the envelope hopper. In FIG. 3, the discharge end of the recess is denoted 36 and the entry end thereof is denoted 38. An envelope flap is denoted 40 in FIGS. 2 and 3 and the body of the envelope is denoted 42 in FIG. 2. As best understood in connection with FIG. 3, leading end 44 of flap 40 has been fully deflected by recess 34 and the trailing end of said flap has not yet entered into said recess.

As depicted in FIG. 2, a small space 46 is defined between the top or uppermost peripheral edge of wheel 22 and top part 30 of housing 26. As an envelope having a closed flap is pulled from the unillustrated hopper toward sheet insertion station 80 (FIG. 1), the flap-including longitudinal edge of said envelope must pass through said space 46. The upper peripheral edge of roller 22 is spaced slightly above the plane of support plate 82 that is inlaid into table 84. Thus, the flap-including longitudinal edge of the envelope is lifted slightly from support plate 82 as depicted in said FIG. 2. The lowermost point of recess 34 is positioned substantially coplanar with the plane of support plate 82, thereby constraining said flap-including longitudinal edge of envelope 42 to bend as depicted. This causes flap 40 to project upwardly at an angle as depicted, thereby partially opening said flap and facilitating the insertion of stationary blade 60 (FIG. 1) thereunder. As flap 40 continues its passage through recess 34, (in a left-to-right path of travel as viewed in FIG. 3) the trailing part thereof is also gradually opened as mentioned earlier. The passage of flap 40 is facilitated by the rotation of wheel 22. The flap-opening work would still be accomplished even if wheel 22 did not rotate, but the rotation desireably reduces friction or drag on the envelope as it is pulled through pre-opener 20.

The position of wheel 22 is adjustable by selectively positioning its axle in any one of bores 28*a–d* (FIG. 3).

Figure 4:
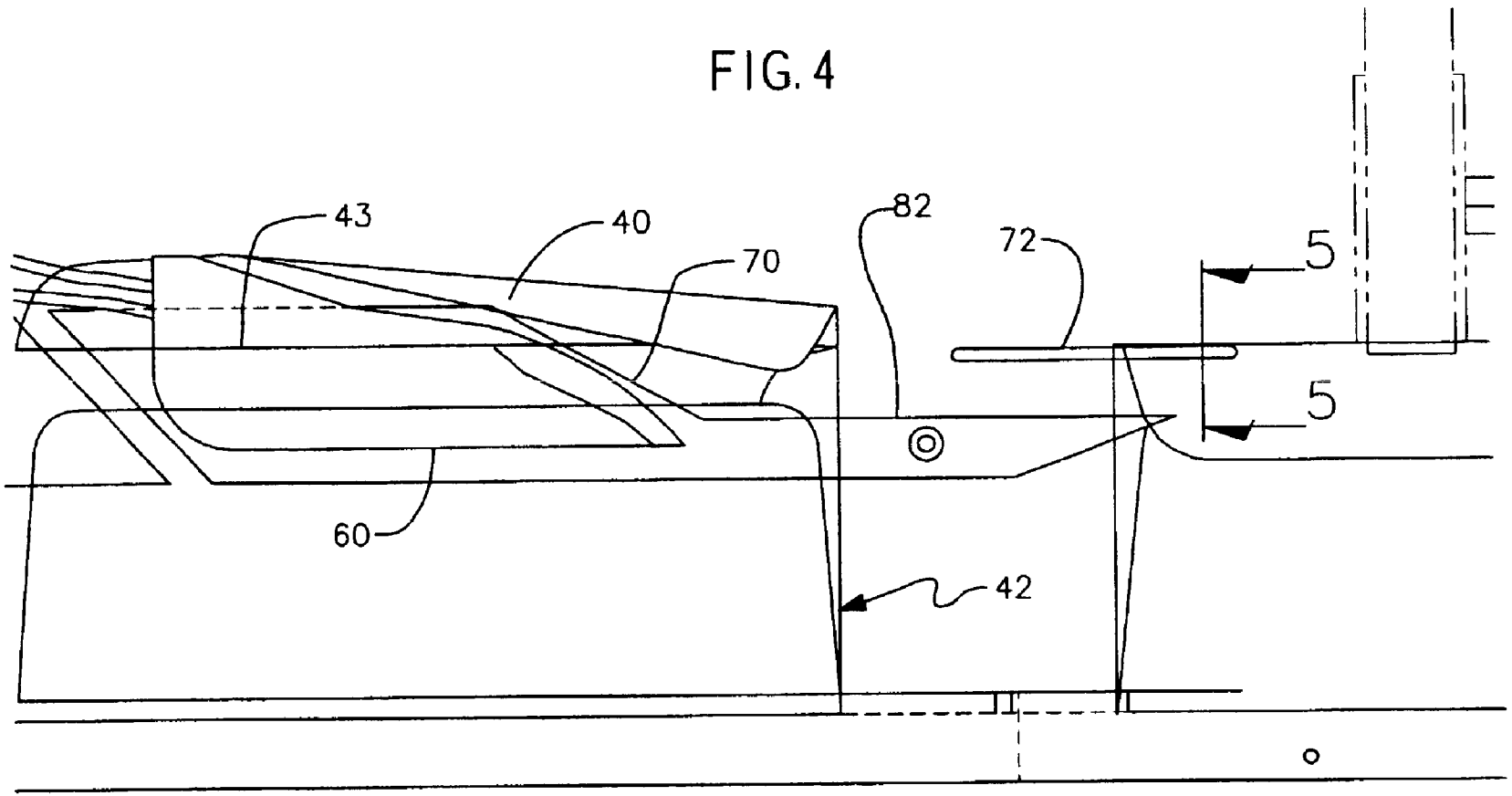
FIG. 4 is a diagrammatic top plan view of a second embodiment of means for pre-opening an envelope.
Figure 5:
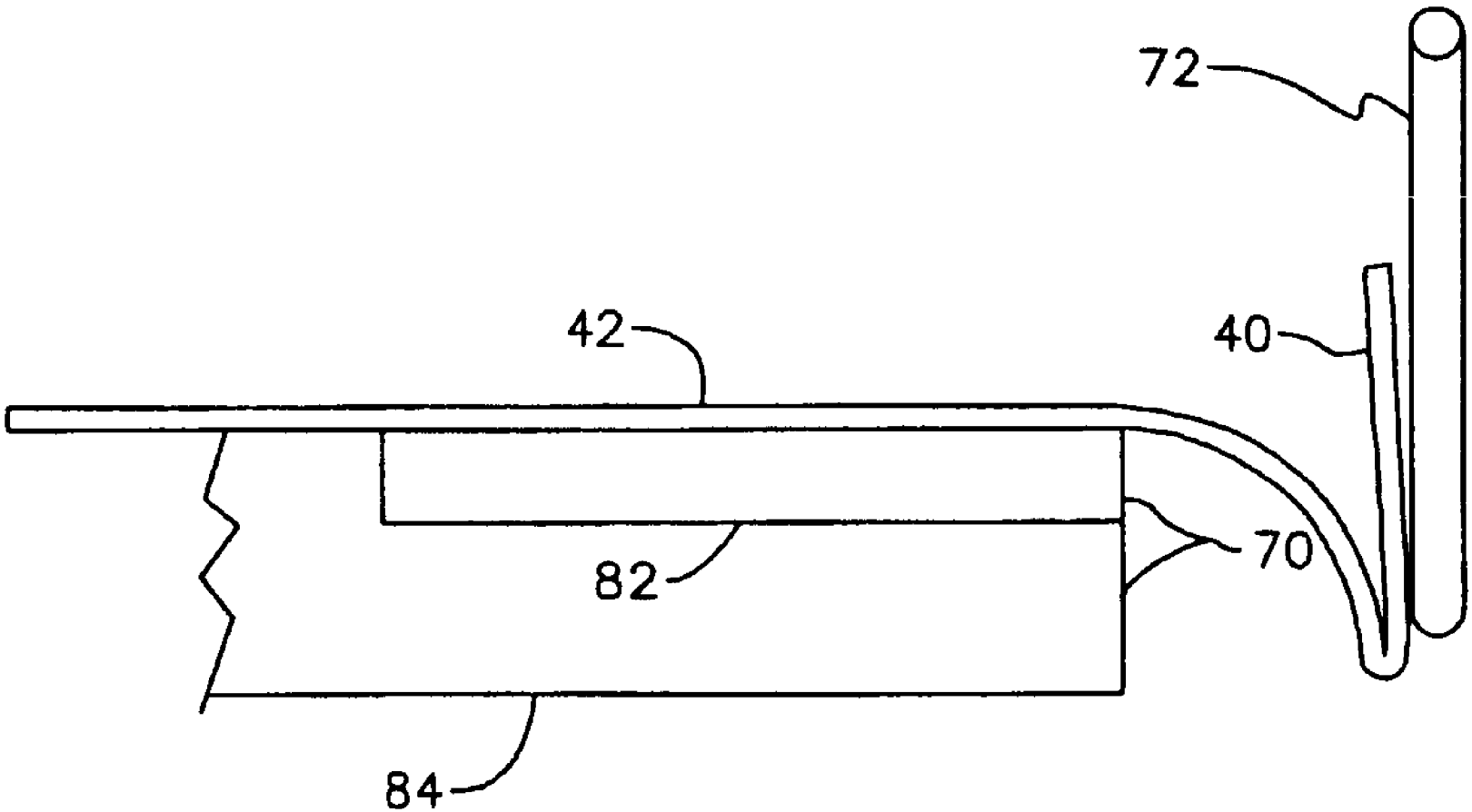
FIG. 5 is a sectional view taken along line 5—5 in FIG. 4.

A second embodiment of the envelope pre-opening means eliminates pre-opener 20. In this embodiment, a ridid deflector arm 72 is positioned between the unillustrated envelope hopper and stationary blade 60, as depicted in FIG. 4. Support plate 82 and table 84 are cut out as at 70 so that the flap-including longitudinal edge of an envelope 42 is unsupported by said support plate in the region of the cut away. As depicted in FIG. 5, rigid deflector arm 72 extends from a point above the plane of support plate 82 to a point below said plane. The uppermost end of rigid deflector arm 72 is secured to the high speed machine at a suitable location. In this way, the flap-including longitudinal edge of an envelope traveling from the unillustrated envelope hopper to sheet insertion station 80 is deflected by said deflector arm 72 to a point below said plane of said support plate, thereby causing flap 40 of envelope 42 to project upwardly as depicted in said FIG. 5 and facilitating insertion of stationary blade 60 thereunder as best understood in connection with FIG. 4.

An envelope 42 that has arrived at sheet insertion station 80 is held at its leading end by an unillustrated clamp means. As described in the incorporated application, a plurality of airjets, not depicted in this disclosure, lying in a horizontal plane (being formed in the leading end of a sheet feeder table), blow into the main body of envelope 42, after flap 40 thereof has been opened by stationary blade 60, to hold it open for the sheet insertion process. However, the clamp means, which clamps down on opposed outer surfaces of the main body of the envelope, will sometimes prevent full opening of the envelope at the leading end thereof.

To augment the effectiveness of the horizontal air jets, plural recesses, denoted 92*a*, 92*b*, 92*c*, and 92*d*, and hereinafter referred to as vacuum dishes, are formed in support plate 82 at the preselected locations depicted in FIG. 1. More particularly, support plate 82, in this embodiment, is formed in two parts. Stationary vacuum dish 92*a* is formed in stationary part 82*a* and movably mounted vacuum dishes 92*b*, 92*c*, and 92*d* are formed in movably mounted support plate 82*b*. Double-headed directional arrow 83 indicates the two directions of mobility of support plate 82*b*.

Each vacuum dish 92*a–d* is in fluid communication with a vacuum source either directly or through a manifold means. The timing of the activation of the vacuum is performed by suitable means. In a preferred embodiment, only two of the vacuum dishes are in open communication with the vacuum source at a time. Stationary vacuum dish 92*a* and vacuum dish 92*b* are simultaneously activated when a relatively short envelope is in use. Stationary vacuum dish 92*a* and vacuum dish 92*c* are simultaneously activated when a medium length envelope is in use, and stationary vacuum dish 92*a* and vacuum dish 92*d* are simultaneously activated when a relatively long envelope is in use.

When a vacuum is selectively transmitted to vacuum dishes 92*a* and 92*b*, or 92*a* and 92*c*, or 92*a* and 92*d*, the bottom or address side of envelope 42 is pulled downwardly by the vacuum, thereby increasing the spacing between the address side and the opposing side, and thereby ensuring that sheets may be inserted into the envelope without obstruction. The vacuum is sufficiently strong to overcome the effects of the clamp holding the leading end of the envelope. Advantageously, the horizontally-flowing air streams serve to separate the opposing sides of the envelope from one another so that the suction acting on the address side of the envelope is not transmitted to the opposite side thereof, i.e., the air streams create a shearing effect that facilitates the separation of the front and back sides of the envelopes.

When sheets are to be inserted into extra long envelopes, movably mounted slide plate 82*b* is displaced to the right as drawn in FIG. 1, i.e., in the direction of the unillustrated envelope hopper. Screws 86*a*, 86*b* are loosened to enable such sliding motion, and they are re-tightened when properly re-positioned. The vacuum lines that lead from the unillustrated vacuum source are sufficiently lengthy and flexible to accommodate the changes in position of slide plate 82*b*.

This invention represents a major breakthrough in the art of high-speed machines for inserting sheets into envelopes. Being drawn to a pioneering invention, the claims that follow are entitled, as a matter of law, to broad interpretation to protect the heart or essence of the invention from piracy.

It will thus be seen that the objects set forth above, and those made apparent from the foregoing description, are efficiently attained. Since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described,

What is claimed is:

1. An apparatus for at least partially opening an envelope, said apparatus forming a part of a machine for inserting sheets into envelopes, comprising:

a table having a support surface adapted for supporting envelopes as they are carried from a first station of said machine to a second station of said machine; envelope alignment means for aligning said envelopes relative to said support surface so that a flap-including longitudinal edge of said envelopes at least slightly overhangs a preselected edge of said table as said envelopes are carried from said first to said second station;

a roller housing mounted to said preselected edge of said table at a preselected location between said first and second stations;

an upwardly opening channel of predetermined depth formed in said roller housing, said upwardly opening channel dividing said roller housing into an inboard part that is contiguous to said table edge and an outboard part that is spaced apart from said inboard part;

a roller mounted for rotation in said roller housing;

said roller having an uppermost peripheral edge extending above said support surface of said table by a preselected distance;

said roller housing having a top part disposed in surmounting relation to said outboard part of said roller housing;

an envelope edge-receiving space formed between said uppermost peripheral edge of said roller and said top part;

said envelope edge-receiving space having at least a part thereof positioned below said uppermost peripheral edge of said roller;

said envelope edge-receiving space receiving a longitudinal edge of an envelope having a closed flap when said envelope is transported from said first station to said second station;

whereby said flap-including longitudinal edge of an envelope extends over said uppermost peripheral edge of said roller and into said envelope edge-receiving space, thereby imparting a curvature to said flap-including longitudinal edge of said envelope and thereby causing at least a partial opening of said flap.

2. The apparatus of claim 1, further comprising a tapered recess formed in said top part, said recess tapering downwardly in height in a direction from said first station toward said second station so that said flap opens gradually to a greater extent as said envelope travels away from said first station.

* * * * *